United States Patent [19]

Van Oijen et al.

[11] Patent Number: 4,872,328

[45] Date of Patent: Oct. 10, 1989

[54] DOOR LOCK FOR A MOTOR VEHICLE

[75] Inventors: Lambertus J. Van Oijen, Budel; Fokke Willems, Heeze, both of Netherlands

[73] Assignee: Volvo Car B.V., Netherlands

[21] Appl. No.: 916,911

[22] Filed: Oct. 9, 1986

[30] Foreign Application Priority Data

Oct. 10, 1985 [NL] Netherlands ..... 8502763

[51] Int. Cl.[4] ..... E05B 65/20

[52] U.S. Cl. ..... 70/237; 70/256; 292/DIG. 23

[58] Field of Search ..... 70/237, 256, 257, 174; 296/150, 52, 53, 56, 57 R, 146; 292/DIG. 23; 49/394

[56] References Cited

U.S. PATENT DOCUMENTS

| | | | |
|---|---|---|---|
| 1,455,812 | 5/1923 | Schafer | 70/237 |
| 1,533,007 | 4/1925 | Kammerer | 70/237 |
| 1,550,917 | 8/1925 | Mindermann | 70/237 |
| 1,557,167 | 10/1925 | Ives | 70/237 |
| 1,569,868 | 1/1926 | Loeb | 70/237 |
| 2,202,834 | 6/1940 | Clarkson-Jones | 70/264 |
| 2,205,212 | 6/1940 | Lesser | 70/264 |
| 2,314,400 | 3/1943 | Janonis | 292/DIG. 23 X |
| 2,687,031 | 8/1954 | Craig | 70/285 |
| 4,127,018 | 11/1978 | Brand | 70/237 X |
| 4,580,821 | 4/1986 | Genord, Jr. et al. | 292/DIG. 31 X |

FOREIGN PATENT DOCUMENTS

| | | | |
|---|---|---|---|
| 0171160 | 2/1986 | European Pat. Off. . | |
| 3444898 | 3/1986 | Fed. Rep. of Germany . | |
| 2478174 | 9/1981 | France | 70/237 |
| 2091658 | 8/1982 | United Kingdom | 70/237 |

*Primary Examiner*—Lloyd A. Gall

*Attorney, Agent, or Firm*—Pennie & Edmonds

[57] ABSTRACT

A door lock for a motor vehicle provided with a body having one or more doors, wherein the lock comprises a locking cylinder accommodated in or near a window pillar. The lock itself and inner and outer handles for operating the lock are located in a lower part of the door and are connected to the locking cylinder by a locking lever. A vertical separation is thus provided between the locking cylinder and the lock itself.

1 Claim, 2 Drawing Sheets

DOOR LOCK FOR A MOTOR VEHICLE

BACKGROUND OF THE INVENTION

The invention relates to a door lock for a motor vehicle provided with a body having one or more doors.

Door locks of this type are generally provided with a cylinder and a matching key whereby the vehicle can be locked and unlocked. The lock cylinder is generally mounted either in the immediate vicinity of or integral with the handle whereby the door is opened.

These locations of the cylinder have several disadvantages. Thus, the fairly low positioning implies that one must generally stoop in order to insert the key into the lock and, in addition, the door has as a rule to be reinforced at the location of the handle by means of special bracings. Also, the paintwork on the outer panel of the door is liable to local damage.

According to the invention the lock cylinder is mounted in or near a pillar of the door in a sheet metal part present there, which cylinder co-operates with a locking lever with which the lock can be opened and closed. This location ensures that the cylinder is accommodated in a pillar which is per se non-deformable and moreover, located at a short distance from that part of the lock which links up anyway with the pillar, so that an effective separation is achieved between the actual locking function and the opening and shutting of the door.

BRIEF DESCRIPTION OF THE DRAWING

The invention is elucidated more fully with reference to the accompanying drawings, in which FIG. 1 schematically shows a part of a motor vehicle provided with a door lock according to our invention in a first embodiment thereof.

DESCRIPTION OF THE PREFERRED EMBODIMENT

Figure 1:
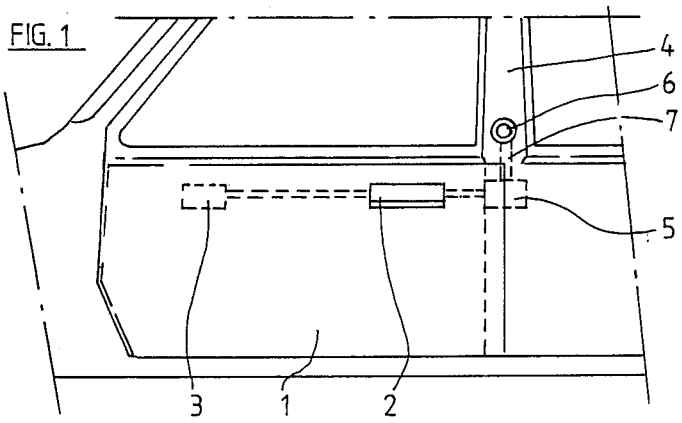
Figure 2:
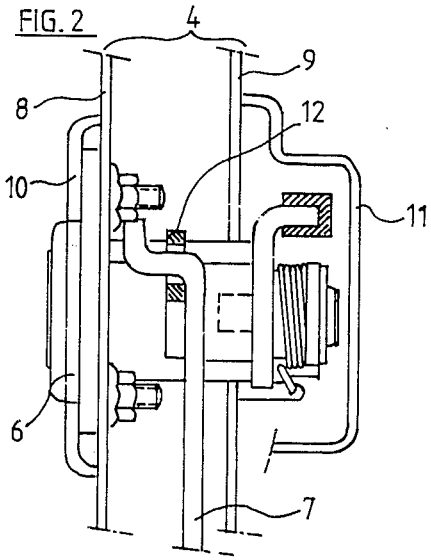
FIG. 2 is a cross-sectional view of the lock of FIG. 1.
Figure 3:
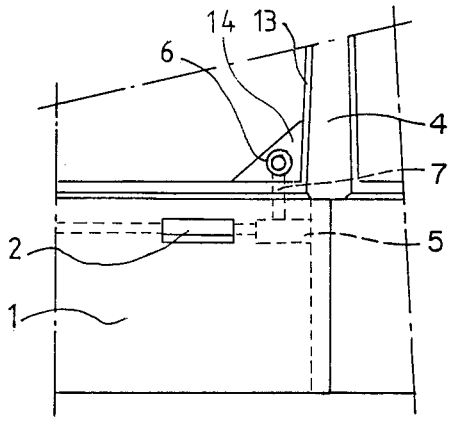
FIG. 3 shows a portion of a motor vehicle provided with a door lock according to our invention in a second embodiment thereof.
Figure 4:
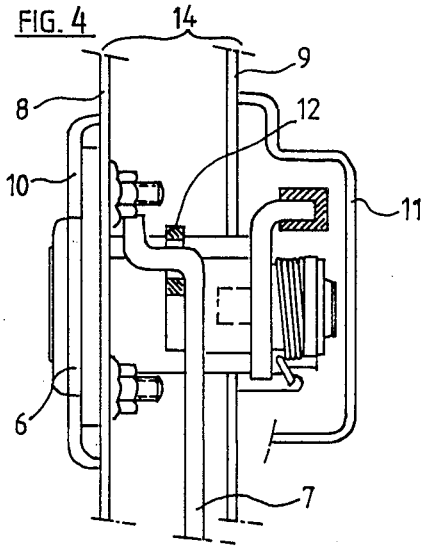
FIG. 4 shows a cross section of the lock of FIG. 3.

In the figures, 1 denotes a car door provided with a handle 2 for opening and shutting on the outside and with a handle 3 for the same purpose, but operable from within. A center pillar 4 of the body accommodates the fixed part 5 of the door lock. The moving part of the lock is connected to the door and not represented. In the embodiment of FIGS. 3 and 4, the lock cylinder 6 is accommodated in a triangular sheet metal member 14 which partially defines the window opening, which cylinder 6 controls locking and unlocking of the lock by means of a locking lever 7 carried in the door. The cover plate 10 on the outside and the cover plate 11 on the inside enclose the lock cylinder 6. By means of a key the lever 12 is turned, which causes the locking lever 7 to move up and down for locking and unlocking the lock. In the embodiment of FIGS. 1 and 2, the lock cylinder 6 is accommodated by the window pillar 4, that is, is fixed on the body of the car. Cylinder 6 again controls operation of the lock through locking lever 7, which in this case is also carried by the body of the vehicle.

We claim:

1. A door lock and door construction for a motor vehicle provided with a body having one or more doors, said door comprising a lower part and an upper part, said upper part further comprising a window pillar, such that said window pillar and said lower part partially define a window opening, said lower part further comprising a door lock being operable by inner and outer handles disposed in said lower part for opening and closing the door, said upper part further comprising a substantially right-triangularly shaped member formed of sheet metal wherein the right-angled sides of said sheet metal member are fixed to said window pillar and to said lower part such that the hypotenuse of said sheet metal member further defines said window opening, and wherein said sheet metal member has mounted therein a locking cylinder, said locking cylinder being operatively connected by a locking lever to said door lock for locking and unlocking said door lock.

* * * * *

UNITED STATES PATENT AND TRADEMARK OFFICE

CERTIFICATE OF CORRECTION

PATENT NO. : 4,872,328

DATED : October 10, 1989

INVENTOR(S) : Lambertus J. Van Oijen et al

It is certified that error appears in the above-identified patent and that said Letters Patent is hereby corrected as shown below:

The Title page showing the illustrative figure should be deleted to appear as per attached title page.

Signed and Sealed this

Fifth Day of May, 1992

*Attest:*

*Attesting Officer*

DOUGLAS B. COMER

*Acting Commissioner of Patents and Trademarks*

United States Patent [19]

Van Oijen et al.

[11] Patent Number: 4,872,328

[45] Date of Patent: Oct. 10, 1989

[54] DOOR LOCK FOR A MOTOR VEHICLE

[75] Inventors: Lambertus J. Van Oijen, Budel; Fokke Willems, Heeze, both of Netherlands

[73] Assignee: Volvo Car B.V., Netherlands

[21] Appl. No.: 916,911

[22] Filed: Oct. 9, 1986

[30] Foreign Application Priority Data

Oct. 10, 1985 [NL] Netherlands ..... 8502763

[51] Int. Cl.[4] ..... E05B 65/20

[52] U.S. Cl. ..... 70/237; 70/256; 292/DIG. 23

[58] Field of Search ..... 70/237, 256, 257, 174; 296/150, 52, 53, 56, 57 R, 146; 292/DIG. 23; 49/394

[56] References Cited

U.S. PATENT DOCUMENTS

| | | | |
|---|---|---|---|
| 1,455,812 | 5/1923 | Schafer | 70/237 |
| 1,533,007 | 4/1925 | Kammerer | 70/237 |
| 1,550,917 | 8/1925 | Mindermann | 70/237 |
| 1,557,167 | 10/1925 | Ives | 70/237 |
| 1,569,868 | 1/1926 | Loeb | 70/237 |
| 2,202,834 | 6/1940 | Clarkson-Jones | 70/264 |
| 2,205,212 | 6/1940 | Lesser | 70/264 |
| 2,314,400 | 3/1943 | Janonis | 292/DIG. 23 X |
| 2,687,031 | 8/1954 | Craig | 70/285 |
| 4,127,018 | 11/1978 | Brand | 70/237 X |
| 4,580,821 | 4/1986 | Genord, Jr. et al. | 292/DIG. 31 X |

FOREIGN PATENT DOCUMENTS

| | | | |
|---|---|---|---|
| 0171160 | 2/1986 | European Pat. Off. . | |
| 3444898 | 3/1986 | Fed. Rep. of Germany . | |
| 2478174 | 9/1981 | France | 70/237 |
| 2091658 | 8/1982 | United Kingdom | 70/237 |

*Primary Examiner*—Lloyd A. Gall

*Attorney, Agent, or Firm*—Pennie & Edmonds

[57] ABSTRACT

A door lock for a motor vehicle provided with a body having one or more doors, wherein the lock comprises a locking cylinder accommodated in or near a window pillar. The lock itself and inner and outer handles for operating the lock are located in a lower part of the door and are connected to the locking cylinder by a locking lever. A vertical separation is thus provided between the locking cylinder and the lock itself.

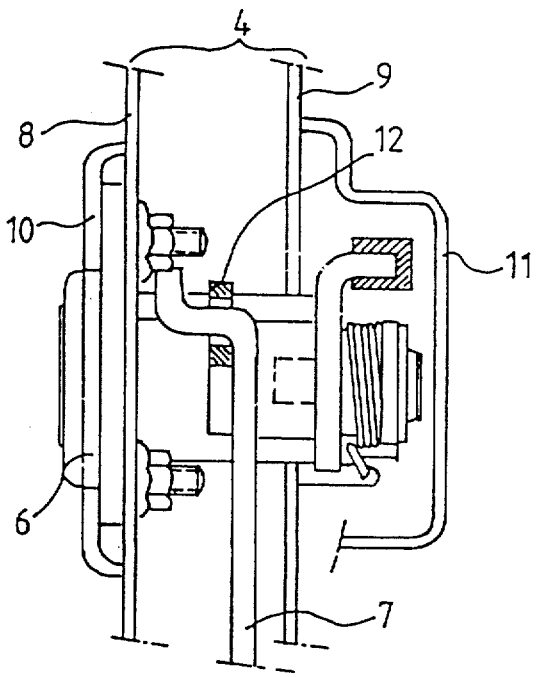

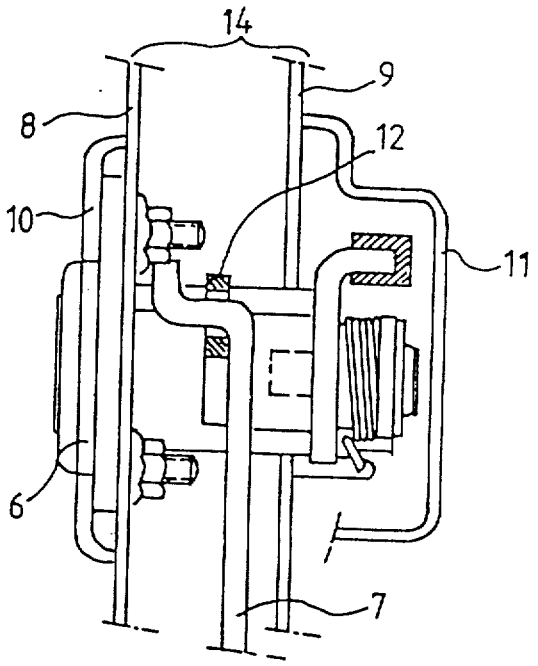

1 Claim, 2 Drawing Sheets